US006334036B1

(12) United States Patent
Mitchell et al.

(10) Patent No.: US 6,334,036 B1
(45) Date of Patent: Dec. 25, 2001

(54) METHOD OF REMANUFACTURING COROTRONS

(75) Inventors: John A. Mitchell; Michael G. Petranto, both of Webster; Leslie R. Kilian, Fairport; F. Bruce Meyer, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/572,554

(22) Filed: May 16, 2000

Related U.S. Application Data

(62) Division of application No. 08/753,458, filed on Nov. 25, 1996, now Pat. No. 6,144,826.

(51) Int. Cl.[7] ..... G03G 15/02

(52) U.S. Cl. ..... 399/170; 399/115; 399/171; 399/172

(58) Field of Search ..... 399/109, 110, 399/111, 113, 115, 119, 168, 170, 171, 172; 29/25.01, 25.02, 25.03, 134.3, 592.1, 602.1

(56) References Cited

U.S. PATENT DOCUMENTS

| | | | | |
|---|---|---|---|---|
| 3,499,143 | | 3/1970 | Martin | 250/49.5 |
| 3,778,622 | | 12/1973 | Kobayashi et al. | 250/324 |
| 4,549,244 | | 10/1985 | Driessen | 361/229 |
| 4,627,701 | | 12/1986 | Onoda et al. | 355/3 CH |
| 4,754,305 | | 6/1988 | Fantuzzo et al. | 355/3 CH |
| 4,841,146 | | 6/1989 | Gundlach et al. | 250/324 |
| 4,843,422 | * | 6/1989 | Mampaey et al. | 399/170 |
| 4,914,480 | | 4/1990 | Endo | 355/221 |
| 5,008,538 | | 4/1991 | DeCecca et al. | 250/324 |
| 5,140,367 | | 8/1992 | Oleksinki et al. | 355/133 |
| 5,181,069 | | 1/1993 | Oleksinki et al. | 355/133 |
| 5,324,941 | | 6/1994 | Gross et al. | 250/324 |
| 5,335,050 | | 8/1994 | Osbourne et al. | 355/221 |
| 5,424,540 | | 6/1995 | Garcia et al. | 250/326 |
| 5,449,906 | | 9/1995 | Osbourne | 250/324 |
| 5,576,820 | | 11/1996 | Hagihara et al. | 355/274 |
| 5,614,997 | | 3/1997 | Marumoto | 399/121 |
| 5,689,775 | | 11/1997 | Marumoto | 399/121 |
| 5,870,654 | * | 2/1999 | Sato et al | 399/109 |

* cited by examiner

*Primary Examiner*—Arthur T. Grimley
*Assistant Examiner*—Hoang Ngo
(74) *Attorney, Agent, or Firm*—Andrew R. Ryan; Joseph M. Young

(57) ABSTRACT

A corona generator including a body and a first support secured to the body is provided. The corona generator also includes a second support secured to the body and spaced from the first support. The corona generator also includes an electrode mounted to the first support and to the second support.

8 Claims, 6 Drawing Sheets

METHOD OF REMANUFACTURING COROTRONS

This application is a divisional of application Ser. No. 08/753,458, filed Nov. 25, 1996, now U.S. Pat. No. 6,144,826.

The present invention relates to a method and apparatus for charging a substrate in electrophotographic printing. More specifically, the invention relates to repairing a charging device.

In the well-known process of electrophotographic printing, the photoconductive member is electrostatically charged, and then exposed to a light pattern of an original image to selectively discharge the surface in accordance therewith. The resulting pattern of charged and discharged areas on the photoconductive member forms an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the photoconductive member is cleaned from the surface thereof. The process is useful for light lens copying from an original or printing electronically generated or stored originals such as with a raster output scanner (ROS), where a charged surface may be imagewise discharged in a variety of ways.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray which imparts electrostatic charge to the surface of the photoreceptor. One particular device would take the form of a single corona wire strung between insulating end blocks mounted on either end of a channel or shield.

The single corotron wire is typically very delicate. The single corotron wire has a diameter of 0.001 inches and is made of a electrical conductive material, i.e., tungsten. Installing the single corona wire onto insulating end blocks of the corona generating device is very difficult. In particular, securing the ends of the single corona wire to the corona device is particularly difficult. Utilizing typical fasteners, such as bolts and screws to secure the wire, tends to overtighten the wire causing it to break. Use of adhesive to secure the wire to the corotron device is very time consuming in that the wire must be held in position as the adhesive dries. Welding of the wire to the corotron device is found to be particularly effective in that by welding, the wire is durably secured to the housing. Also, the welding process can occur very quickly providing for rapid and inexpensive assembly of the wire onto the housing.

Recently, to ease servicing of a copy machine or printing machine, customer replaceable units (CRUs) have been designed for easy removal from the copy machine by a copy machine operator. These customer replaceable units include those components which most quickly wear within the machine. For example, the customer replaceable unit may include the marking particles or toner as well as the photoreceptor, the cleaning blade, and the corotron wire. Alternatively, the CRU may include multiple CRUs. For example, the corotron may be included in a CRU having the photoreceptor, the cleaning blade, and the corotron wire. The corotron wire is typically permanently welded to the housing of the customer replaceable unit. To permit the assembly of the customer replaceable unit, typically, the housing of the CRU is made of more than one component. One of these components has the corotron wire welded thereto.

The CRUs are changed several times during the life of the copy machine. Recently, CRUs are being remanufactured rather than being replaced as a new unit. These CRUs are inspected and wear components, for example, the cleaning blade, corotron wire and photoreceptor, may require replacement. In those situations where the corotron wire must be replaced, since the wire is integrally welded to the portion of the frame of the CRU, the frame as well as the wire must be discarded during remanufacturing. This increases the cost of remanufacturing CRUs as well as requiring a portion of the frame be discarded or recycled.

The present invention is intended to eliminate at least some of the aforementioned problems.

The following disclosures may be relevant to various aspects of the present invention:

U.S. Pat. No. 5,140,367

Patentee: Olekinski, et al.

Issue Date: Aug. 18, 1992

U.S. Pat. No. 5,181,069

Patentee: Olekinski, et al.

Issue Date: Jan. 19, 1993

U.S. Pat. No. 4,754,305

Patentee: Fantuzzo et al.

Issue Date: Jun. 28, 1988

U.S. Pat. No. 4,627,701

Patentee: Onoda et al.

Issue Date: Dec. 9, 1986

U.S. Pat. No. 4,549,244

Patentee: Driessen

Issue Date: Oct. 22, 1985

U.S. Pat. No. 3,499,143

Patentee: Martin

Issue Date: Mar. 3, 1970

U.S. Pat. No. 5,140,367 discloses a method and apparatus for fitting a replacement corotron wire onto a corona wire cartridge. The assembly includes a pair of hook type terminals. The apparatus also includes a replacement wire having a loop at each end of the wire. One of the loops engages one hook terminal and the opposing loop connects to one end of a double hook ended coil spring. The opposing coil spring hook end is mounted on the opposing hook end terminal.

U.S. Pat. No. 5,181,069 discloses a method and apparatus for fitting a replacement corotron wire onto a corona wire cartridge. The assembly includes a pair of hook type terminals and rivets to mount the terminals onto a cartridge frame. The apparatus also includes a replacement wire having a loop at each end. One of the loop engages one hook terminal and the opposing loop connects to one end of a double hook ended coil spring. The opposing coil spring hook end is mounted on the opposing hook end terminal.

U.S. Pat. No. 754,305 discloses a corona discharge device which includes a throw away subassembly. The subassembly can be assembled into the printing machine. The subassembly includes a rectangularly shaped insulative frame and a tungsten wire. The subassembly cooperates with a generally U-shaped, conductive shield to form the corona discharge device.

U.S. Pat. No. 4,627,701 discloses a corona discharge device which includes a shield case, a discharging wire and block portions on which the discharging wire is mounted. The opposite ends of the wire are fixedly secured to the blocks by rivets.

U.S. Pat. No. 4,549,244 discloses a corona generating device including a plurality of separate parallel corona wires supported between insulating end block assemblies. The wires are preferably formed from a single U-shaped wire with a closed end portion wrapped around an arcuate insulating end post and an arcuate insulating end post in the second end block assembly around which the wire is wrapped.

U.S. Pat. No. 4,792,680 discloses a corona generating device including a corona wire. A supply of corona wire of indefinite length is mounted on the corona generating device for which one ore more runs of fresh wire can be periodically withdrawn with provision of releasably holding the wire under tension during periods of use.

SUMMARY OF THE INVENTION

In accordance with one aspect of the present invention, there is provided a corona generator including a body and a first support secured to the body. The corona generator also includes a second support secured to the body and spaced from the first support. The corona generator also includes an electrode mounted to the first support and to the second support.

In accordance with a further aspect of the present invention, there is provided a customer replaceable unit of the type having a corona generator for charging a surface. The corona generator includes a body, and a first support secured to the body. The corona generator also includes a second support secured to the body and spaced from the first support. The corona generator further includes an electrode mounted to the first support and to the second support.

In accordance with another aspect of the present invention, there is provided a printing machine of the type having a corona generating device for charging a surface. The corona generating device includes a body and a first support secured to the body. The corona generator also includes a second support secured to the body and spaced from the first support. The corona generator also includes an electrode mounted to the first support and to the second support.

In accordance with yet another aspect of the present invention, there is provided a method of remanufacturing a corona device having an electrode secured to a housing. The method includes the steps of removing the electrode from the housing, mounting a first support to the housing, mounting a second support to the housing, and attaching a new electrode to the first support and to the second support.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 7:
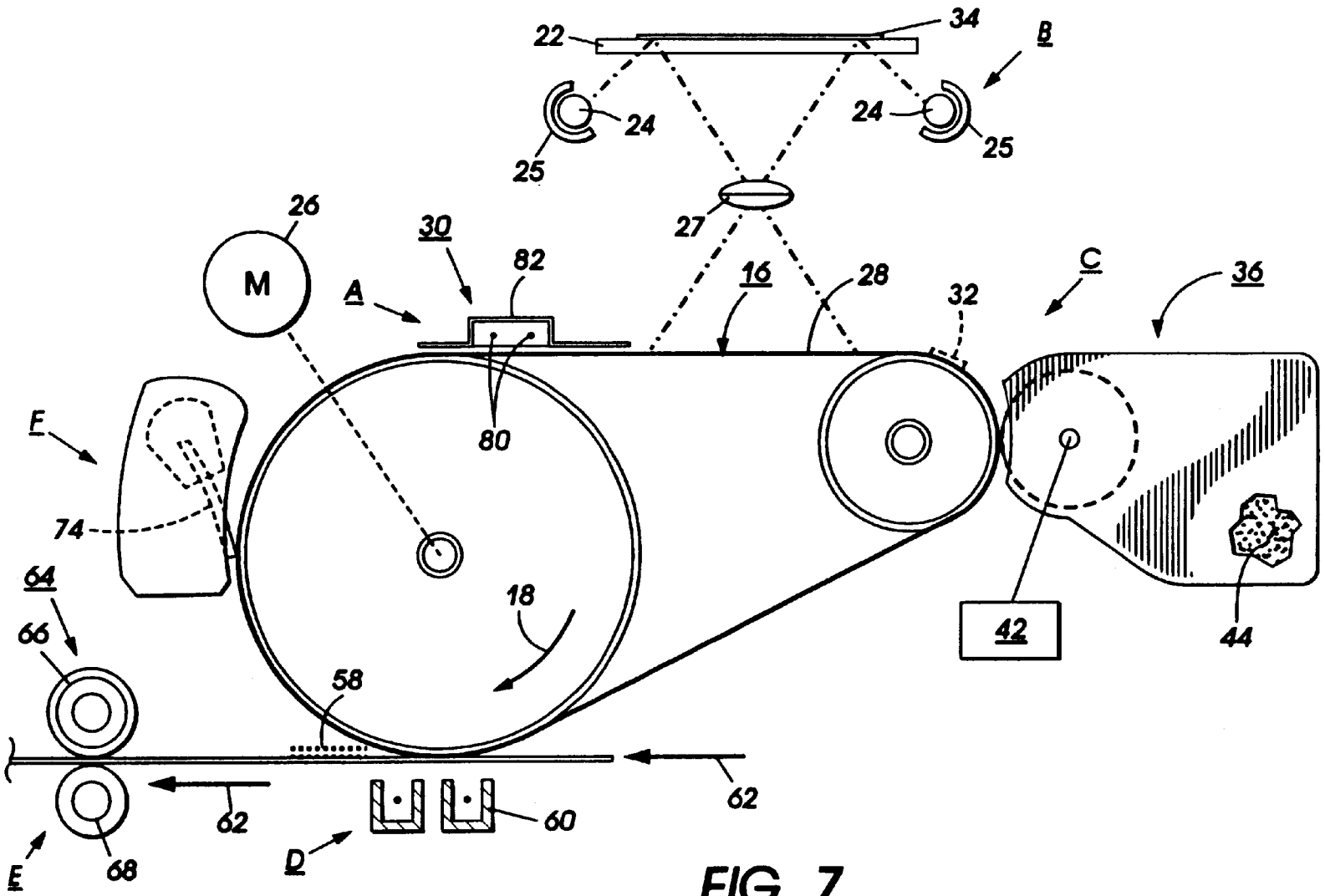
FIG. 7 is a schematic elevational view of an illustrative electrophotographic printing machine incorporating the corona discharge device of the present invention therein.

For a general understanding of the illustrative electrophotographic printing machine incorporating the features of the present invention therein, reference is made to the drawings. In the drawings, like reference numerals have been used throughout to designate identical elements. FIG. 7 schematically depicts the various components of an electrophotographic printing machine incorporating the corona discharge device of the present invention therein. Although the corona discharge device of the present invention is particularly well adapted for use in the illustrative printing machine, it will become evident that these corona discharge devices are equally well suited for use in a wide variety of uses and are not necessarily limited in their application to the particular embodiments shown herein.

Referring now to FIG. 7, the electrophotographic printing machine shown employs a photoconductive member in the form of a belt 16, although photoreceptors in the form of a drum are also known, and may be substituted therefor. The belt 16 has a photoconductive surface deposited on a conductive substrate. Belt 16 moves in the direction of arrow 18 to advance successive portions thereof sequentially through the various processing stations disposed about the path of movement thereof. Motor 26 rotates belt 16 to advance belt 16 in the direction of arrow 18. Belt 16 is coupled to motor 26, by suitable means such as a drive.

Initially, successive portions of belt 16 pass through charging station A. At charging station A, a corona generating device, indicated generally by the reference numeral 30, charges the belt 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the belt 16 by a system of mirrors 25 and lens 27, as shown. The optical image selectively discharges surface 28 of the belt 16 in an image configuration whereby an electrostatic latent image 32 of the original document is recorded on the belt 16 at the imaging station B.

At development station C, a development system or unit, indicated generally by the reference numeral 36 advances developer materials into contact with the electrostatic latent images. The developer unit 36 includes a device to advance developer material into contact with the latent image.

The developer unit 36, in the direction of movement of belt 16 as indicated by arrow 18, develops the charged image areas of the photoconductive surface 28. This developer unit contains black developer, for example, material 44 having a triboelectric charge such that the black toner is urged towards charged areas of the latent image by the electrostatic field existing between the photoconductive surface and the electrically biased developer rolls in the developer unit which are connected to bias power supply 42.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of belt 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the belt 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of belt 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

Referring again to FIG. 7, the corona generating device 30 may include a single corona wire 80. The wire 80 is strung between insulative end blocks of a remanufactured frame or housing 82. Securing the wire 80 to the housing 82 is particularly difficult. The wire 80 typically has a very small diameter, say for example, 0.002 inches, and is made of an electrically conductive material, for example, tungsten. The use of fasteners to secure the wire 80 to the frame 82 causes the wire 80 to be overtightened and to break. The use of adhesive requires long cure times making that process expensive. Welding the wires 80 to the frame 82 is particularly advantageous in that a durable connection can be obtained at low cost.

Figure 3:
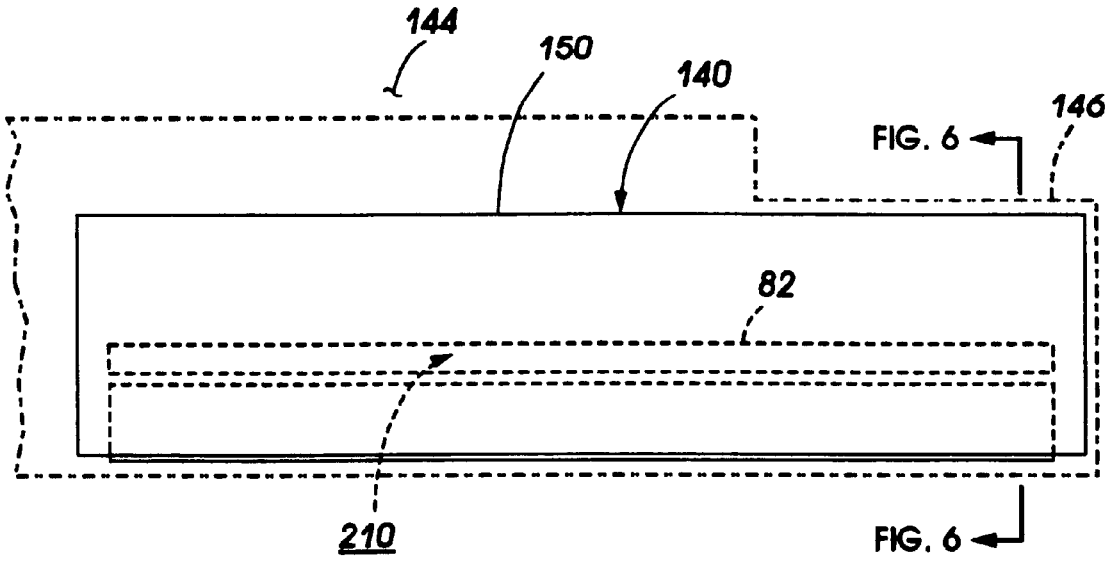
FIG. 3 is an elevational view of the support insert of FIG. 1 for mounting wires to the corotron discharge device according to the present invention installed onto a customer replaceable unit of an electrophotographic copy machine.
Figure 4:
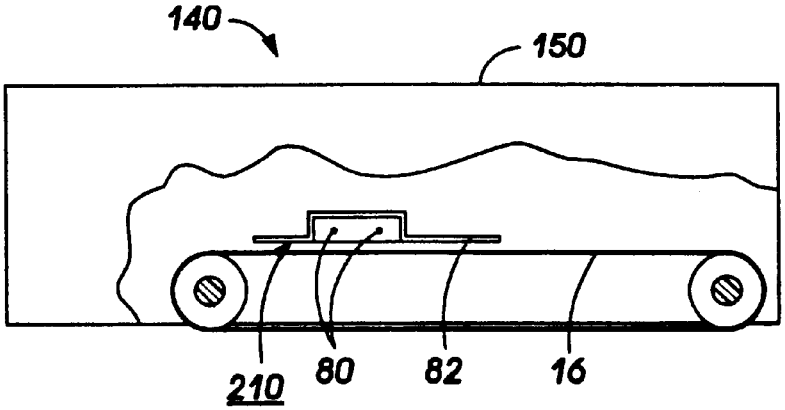
FIG. 4 is an end elevational view of the customer replaceable unit of FIG. 3.

Recently, to aid in the easy servicing of a copy machine or printing machine by an end user, and particularly for small inexpensive copiers, components that regularly wear during the life of the machine are packaged together in CRUs 140 (see FIGS. 3 and 4). The CRUs typically are in the form of a housing which includes the photoreceptor 16, cleaning blade 74, the marking particles, and the corona generating device 30. Alternatively the machine may include several CRUs, each of the CRU including a portion of the components to be replaced by the customer. For example, the CRU may include the photoreceptor 16, cleaning blade 74, and the corona generating device 30.

According to the present invention, and referring to FIGS. 3 and 4, a customer replaceable unit 140 is shown utilizing the corona generating device 30 (see FIG. 7) having the wire mounting support insert the present invention.

To aid in the easy servicing of a copy machine or printing machine, a customer replaceable unit 140 as shown in FIGS. 3 and 4 is typically designed to be easily removed from the copy machine. A typical example for the use of replacement of the customer replaceable unit 140 includes a support structure 144 of the copy machine which includes rails 146 to which housing 150 of the customer replaceable unit 140 matingly slide. The housing 150 preferably includes the wire charge frame 82 from which the wire 80 is supported.

Customer replaceable units 140 are changed several times during the life of the copy machine. The customer replaceable units 140 are recently being remanufactured rather than being replaced with new customer replaceable units.

The customer replaceable unit 140 includes the housing or cartridge 150 to which several components, namely those components found to require replacement on a more frequent basis within a copy machine or printing machine, are mounted. Typically, the customer replaceable unit 140 includes the photoreceptor belt 16, the wire 80 and other items determined to wear at a significant rate. For example, the customer replaceable unit 140 may also include the blade 74 of the cleaning station F (see FIG. 7).

Figure 2:
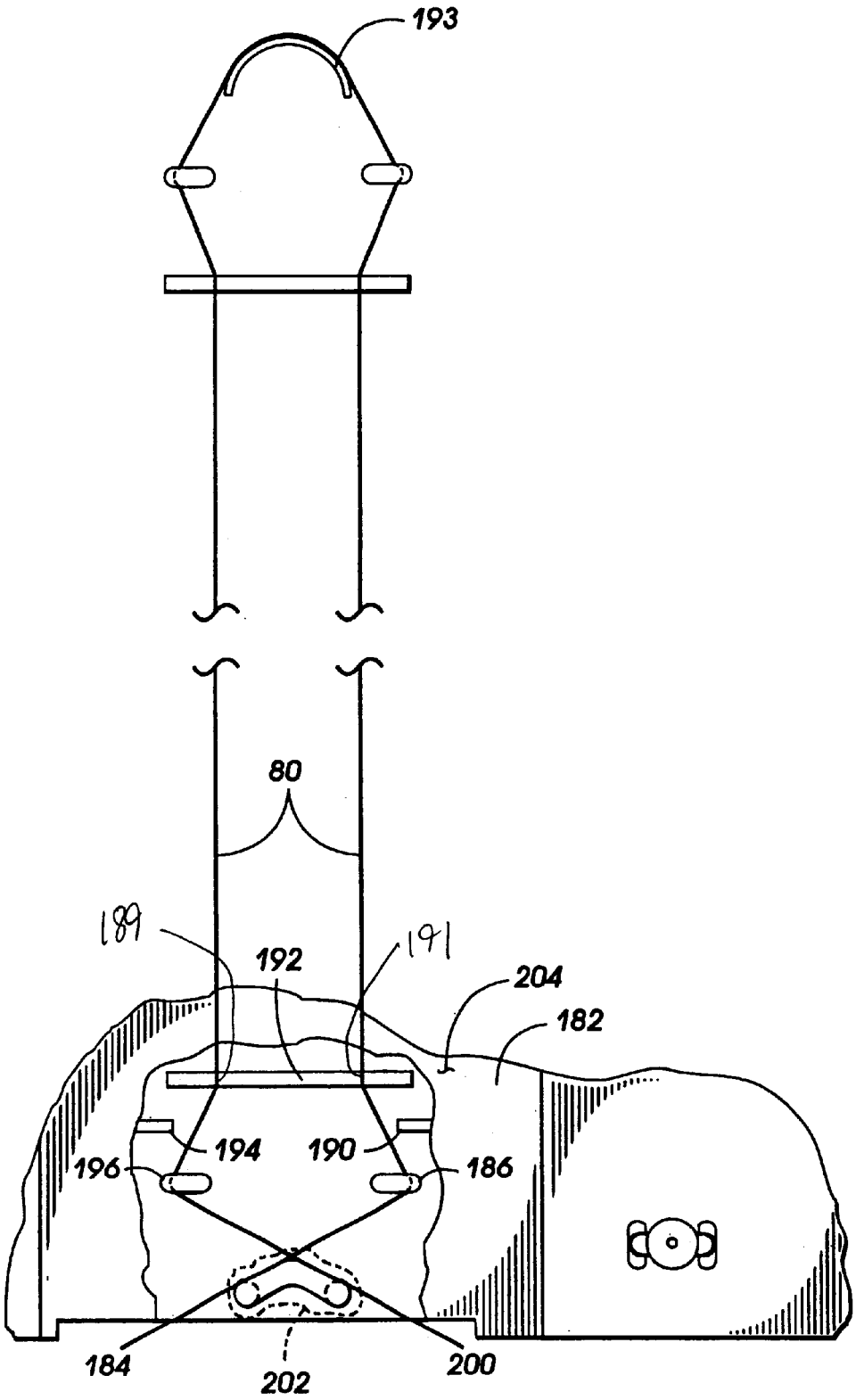
FIG. 2 is a partial plan view of a wire charge frame of an original mounting configuration for mounting wires to the wire charge frame of a customer replaceable unit.

Referring now to FIG. 2, an enlarged portion of an original wire charge frame is shown. Wire charge frame 182 represents a portion of an original wire charge frame as originally manufactured.

The wire charge frame 182 may be made of any suitable material, i.e., a metal or a plastic. Preferably, however, the wire charge frame 182 is made of a plastic, for example, polystyrene.

The corotron charge wire 80 is preferably strung from a first end 184 of the wire 80, around approximately 1 to 4 revolutions of a first hitching post 186, spaced from grid support 190, and against first face 191 of wire guide 192. From wire guide 192, the wire 80 is strung around a wire tensioner in the form of an arcuate rail 193. The arcuate rail 193 is preferably spring biased to provide for an accurately tensioned wire 80. The wire 80 is then positioned against second face 189 of wire guide 192. The wire 80 is then strung spaced from grid support 194, wound around approximately 1 to 4 revolutions second hitching post 196 and then the wire 80 is held in tension at first end 184 and second end 200 of the wire 80. The wire 80 intersects itself near first end 184 and second end 200 of the wire 80. The wire 80 is preferably positioned at upper periphery of raised weld area 202.

While the ends 184 and 200 are held in tension, the weld area 202 near the first and second ends 184 and 200 is contacted with a welding tool (not shown). The welding tool may be used in conjunction with any suitable plastic welder. An ultrasonic welder is particularly well suited for this application. The welder serves to raise the temperature of the wire charge frame to a temperature above the melting point of the wire charge frame, yet below the melting point of the wire 80. Preferably, the weld area 202 protrudes above surface 204 of the wire charge frame. The weld area 202 melts and encases the wire 80

The weld area 202 may have any suitable shape, but preferably is in the form of a chevron or inverted V. When the weld area 202 is melted by the welding tool, the weld area 202 is fused to the wires 80 and the wires 80 are thereby permanently secured to the wire charge frame 182.

When remanufacturing the CRU 140 (see FIGS. 3 and 4), the wire 80 must often be replaced. Without the application of the present invention, the frame 182 would require replacement whenever the wire 80 was found to be worn or defective.

According to the present invention and referring again to FIGS. 3 and 4, a corotron wire assembly 210 is shown as part of the CRU 140.

Figure 6:
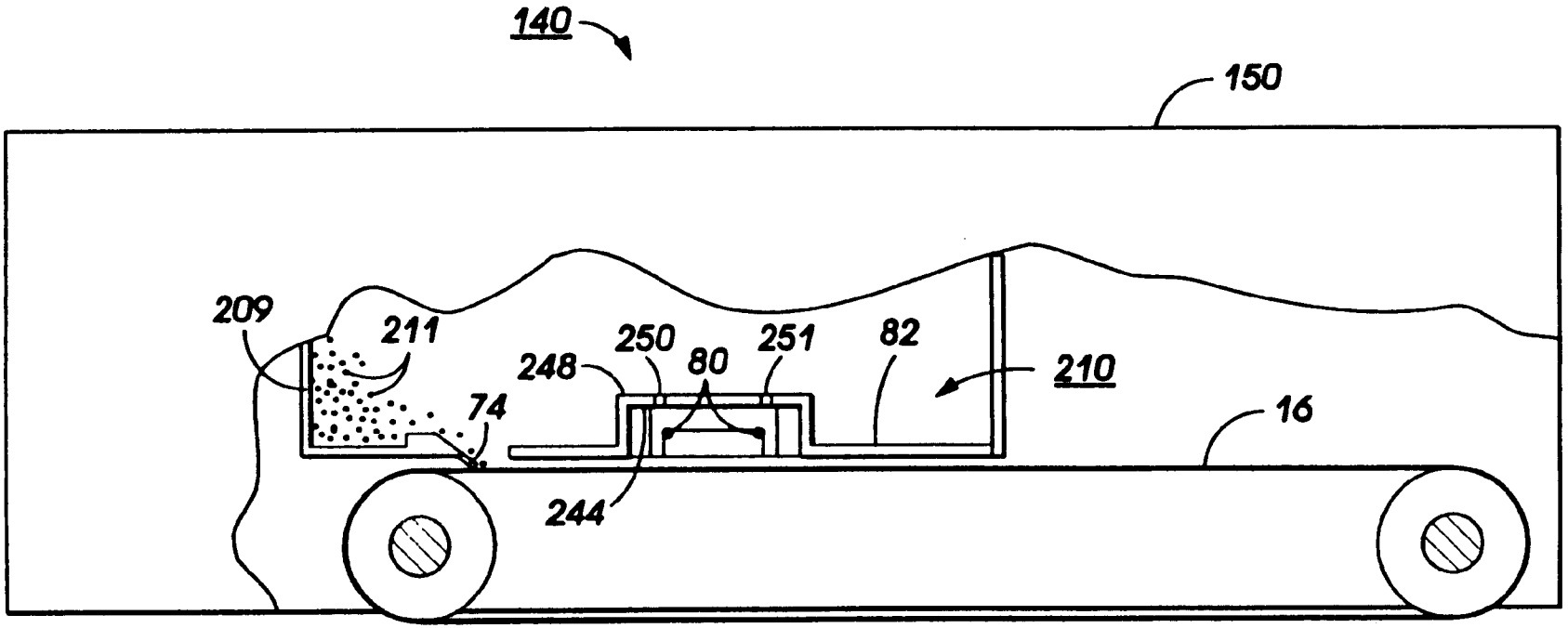
FIG. 6 is a sectional view of FIG. 3 taken along the line 6—6 in the direction of the arrows.

Referring now to FIG. 6, the corotron wire assembly 210 including the wire charge frame 82 is shown in greater detail as part of the frame 150 of the CRU 140. The CRU 140 includes wiper cleaning blade 74, the photoconductive belt 16, wires 80, as well as, a sump 209 for collecting spent toner 211.

Figure 5:
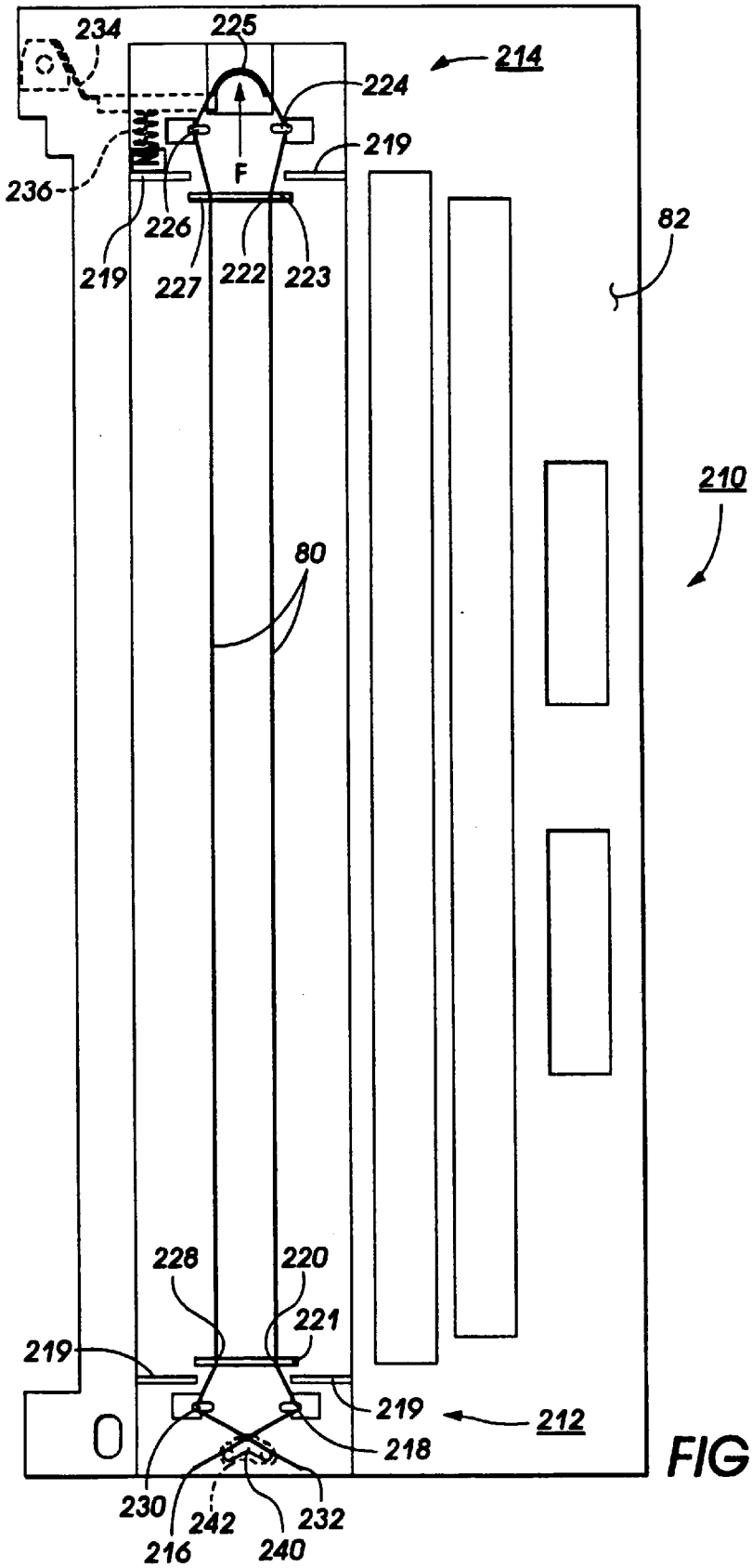
FIG. 5 is a sectional view of FIG. 4 taken along the line 5—5 in the direction of the arrows.

Referring now to FIG. 5, the corotron wire assembly 210 is shown in greater detail. The corotron wire assembly 210 as shown depicts a remanufactured corotron wire assembly 210. The corotron wire assembly includes wire charge frame 82. Wire charge frame 82 may be made of any suitable electrically non-conductive material, for example a plastic. Preferably, however, the wire charge frame 82 is made of a durable plastic, i.e. polystyrene.

The wire 80 is preferably strung between first insulating end block 212 and second insulating end block 214. The end blocks 212 and 214 are preferably integral with the wire charge frame 82. Preferably, the wire 80 is strung from a first end 216 of wire 80, around approximately 1 to 4 revolutions of first hitching post 218, spaced from grid support 219, against first face 220 of first wire guide 221, across the length of the wire charge frame 82, against first face 222 of second wire guide 223, spaced from grid support 219, against but not wrapped around second hitching post 224, around a wire tensioner in the form of an arcuate rail 225, against but not wrapped around third hitching post 226, spaced from grid support 219, against second face 227 of second wire guide 223, across the wire charge frame 82, against second face 228 of first wire guide 221, spaced from grid support 219, around approximately 1 to 4 revolutions fourth hitching post 230, and finally to second end 232.

The first ends 216 and second ends 232 are held in tension with a tensioning device, preferably by spring bias against the arcuate rail 225. Preferably, arcuate rail 225 is pivotally mounted on arm 234. Preferably, the arcuate rail 225 is spring biased outwardly by spring 236. Spring 236 may be any suitable durable spring having a proper spring force and may be chosen along with its position along the arm 234 to provide tensile force F suitable for proper operation of the wire 80. The first end 216 and second end 232 of wire 80 are secured to the wire charge frame 82 by any suitable method, but preferably by welding. Preferably, the wire charge frame 82 includes a raised area or chevron 260 located in weld area 242.

Figure 1B:
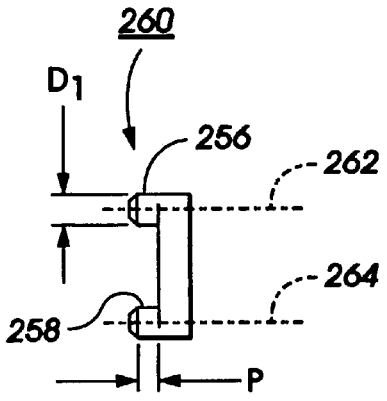
FIG. 1B is an end view of the support insert of FIG. 1A.
Figure 1A:
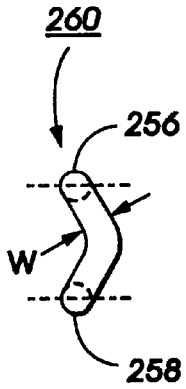
FIG. 1A is a plan view of the support insert of FIG. 1 for use with a wire charge frame to remanufacturing the corotron frames.
Figure 1:
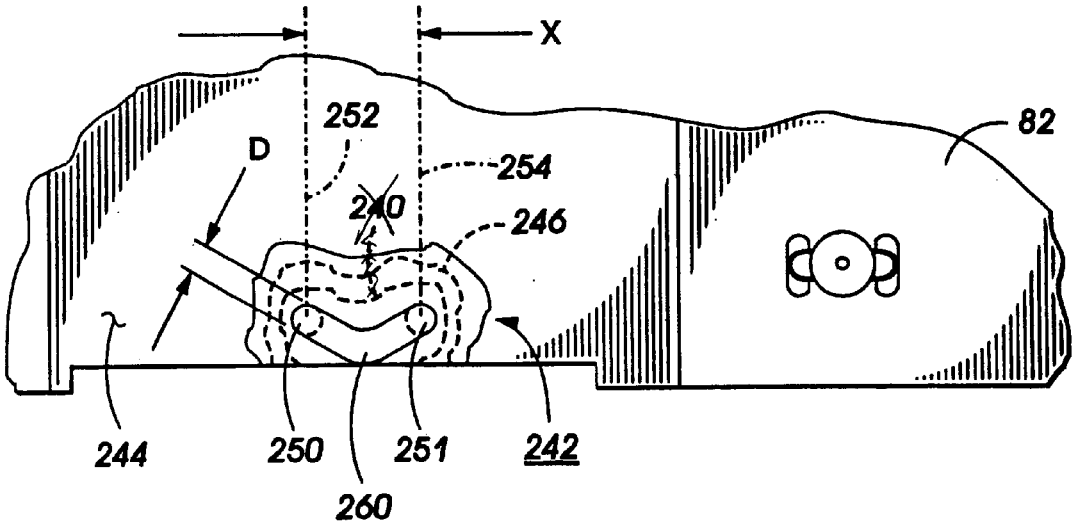
FIG. 1 is a partial plan view of a wire charge frame with a support insert shown in phantom for mounting wires according to the present invention to remanufacturing corotron frames of customer replaceable units of an electrophotographic copy machine.

Referring now to FIG. 1, weld area 242 of the wire charge frame 82 is shown in greater detail. When a used wire charge frame 82 is remanufactured, the wire charge frame 82 includes an original welded area 246 including a melted plastic area which is raised above adjoining surface 244 of the wire charge frame 82. The original weld area 246 is shown in phantom. When remanufacturing the wire charge frame 82, the original weld area is machined away leaving a surface parallel to surface 244. When machining away the original weld area 246, the wires 80 embedded therein are removed as well.

The original weld area 246 may be removed by any suitable apparatus i.e., a milling machine including an end mill or a saw having a saw blade thereon. It should be appreciated that the surface around the original weld area may perform as well if it is slightly above or below the surface 244.

In order to provide a material for welding the wire 80 to the frame 82, preferably, additional material similar to the original material for the frame 82, i.e. a plastic, for example, propylene, must be provided to permit the welding of a remanufactured wire charge frame 82.

The additional plastic material in the original weld area may be attached to the frame 82 by any suitable method, for example, by adhesives, fasteners, or as shown in FIG. 1, include a pair of apertures 250 and 251 which are machined into the original frame 82 perpendicular to surface 244 within the weld area 246. The apertures typically have a diameter D of approximately 1.5 millimeters. The apertures 250 are in the form of circular holes and the centerlines 252 and 254 thereof are positioned a distance X apart of approximately 8.0 millimeters.

Referring again to FIG. 6, the applicants have found that the frame 82 may be prepared by a simple three step process. First, one of the two holes, for example, first hole 250, is drilled from 244 through to surface 248. Since the polystyrene material is soft, burrs will form around first hole 250 at surface 248. A step drill with an integral end mill is used to drill the second hole 251. The step drill enters the frame 82 at surface 248. After the tip of the drill exits surface 244, the integral end mill removes the burr formed by the first drill around first hole 250 on surface 248. Thirdly, a mill is used to remove the old weld, and the wire and the burrs around second hole 251 from the surface 244. For example, the circular periphery of a cylindrical end mill may be passed over the welded area of surface 244. A CNC machining center is suitable for this operation.

Referring now to FIGS. 1A and 1B, the chevron 260 for providing the weld for the wires 82 is shown in the form of chevron insert 260. The chevron insert 260 provides the material to be welded or melted with the wire 80 to secure the wire to the remanufactured frame 82.

Referring now to FIG. 1A, the chevron insert 260 may have any suitable shape. For example, the chevron may be in the form of an inverted V having a width W of approximately 2.0 millimeters. This shape is particularly well suited for welding, as this shape conforms to the angle of intersection of the wire 80 near the ends thereof and also conforms to the shape of the welding tool. The chevron may be in the shape of an inverted V having protrusions 256 and 258 extending from centerlines 262 and 264, respectively, of the chevron insert 260. The protrusions 256 and 258 have a diameter $D_1$ which is approximately the same as diameter D of the apertures 250 and 251. The protrusions 256 and 258 extend a depth P preferably equal to the thickness of the wire charge frame 82, for example, 2.0 millimeters. The protrusions 256 and 258 are respectively fitted into the apertures 250 and 251 of the frame 82. When the welding tool (not shown) melts the chevron insert 260, the protrusions melt and are welded to the frame 82.

When a used remanufactured frame 82 is again milled or machined to remove the wires 80, a similar process may be had utilizing a new chevron insert 260. The chevron insert is shown in phantom in FIG. 1 in position in the weld area 242 of frame 82. Thereby, the frame 82 may be remanufactured several times. For example, applicants have found that the frame 82 may be easily remanufactured at least four times.

By providing a wire charge frame with a replaceable insert for mounting the wires to the corotron frame, a wire charge frame may be remanufactured rather than discarded.

By providing a wire charge frame having apertures which when mated with a chevron having pins, a remanufactured unit may be provided.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method of remanufacturing a corona device comprising:

removing an electrode from a housing comprising machining the housing at the position where the electrode is secured to the housing;

mounting a first support to the housing;

mounting a second support to the housing;

attaching a new electrode to the first support and to the second support;

securing the new electrode using one or more welds; and machining mounting holes in the housing prior to mounting a first support;

wherein mounting the first support and mounting the second support comprises inserting protrusions extending from the first support and the second support into the holes in the housing.

2. The method of claim 1 wherein attaching a new electrode comprises:

stretching the new electrode between the first support and the second support; and welding the new electrode to the first support and to the second support.

3. The method of claim 1 wherein at least one of the first support, second support, and the housing comprise a plastic.

4. The method of claim 1 further comprising spacing the second support from said first support.

5. The method of claim 1 wherein the corona device is part of a customer replaceable unit.

6. The method of claim 1 further comprising providing a tensile force on the new electrode.

7. The method of claim 3 wherein at least one of the first support and the second support comprises a material having a melting temperature below a melting point of the new electrode.

8. The method of claim 2 wherein the housing comprises at least one aperture therein; and wherein at least one of the first support and the second support comprise a protrusion extending at least partially into the at least one aperture.

* * * * *